US006951489B2

(12) United States Patent
Sekiguchi

(10) Patent No.: US 6,951,489 B2
(45) Date of Patent: Oct. 4, 2005

(54) SPRING CONNECTOR FOR SURFACE MOUNTING IN AN ELECTRONIC DEVICE, AND METHOD FOR MANUFACTURING THE SPRING CONNECTOR

(75) Inventor: Toru Sekiguchi, Yamanashi-ken (JP)

(73) Assignee: Citizen Electronics Co., Ltd., Yamanashi-Ken (JP)

( * ) Notice: Subject to any disclaimer, the term of this patent is extended or adjusted under 35 U.S.C. 154(b) by 0 days.

(21) Appl. No.: 10/731,111

(22) Filed: Dec. 10, 2003

(65) Prior Publication Data

US 2004/0127106 A1 Jul. 1, 2004

(30) Foreign Application Priority Data

Dec. 11, 2002 (JP) ..... 2002-360033

(51) Int. Cl.[7] ..... H01R 13/24
(52) U.S. Cl. ..... 439/700; 439/931
(58) Field of Search ..... 439/86, 608, 700, 439/824, 931

(56) References Cited

U.S. PATENT DOCUMENTS 6,685,513 B2 * 2/2004 Bienvenu ..... 439/700
6,716,043 B2 * 4/2004 Ishizuka ..... 439/131
6,758,682 B1 * 7/2004 Kosmala ..... 439/66
6,814,626 B2 * 11/2004 Wen-Yao ..... 439/700

FOREIGN PATENT DOCUMENTS

JP 10 284158 10/1998

* cited by examiner

*Primary Examiner*—Khiem Nguyen
(74) *Attorney, Agent, or Firm*—Dennison, Schultz, Dougherty & MacDonald

(57) ABSTRACT

A spring connector has a case made of resin. Conductive films are formed on an inside wall of a space in the case, on an upper surface of the case, on an outside wall of the case, and on an underside of the case so as to electrically connect the inside wall with the underside of the case. A coil spring is inserted in the space of the case, and a plunger made of metal is slidably mounted in the space, so that the plunger is outwardly urged by the coil spring. A lid is secured to the upper surface of the case for stopping the plunger urged by the coil spring.

5 Claims, 6 Drawing Sheets

SPRING CONNECTOR FOR SURFACE MOUNTING IN AN ELECTRONIC DEVICE, AND METHOD FOR MANUFACTURING THE SPRING CONNECTOR

BACKGROUND OF THE INVENTION

The present invention relates to a spring connector used for surface mounting in an electronic device, and method for manufacturing the spring connector.

As a method for connecting electric parts in an electronic equipment such as a portable telephone to a circuit substrate, a spring connector having a plunger which is slidably mounted in a tube and outwardly urged by a spring is used. The spring connector is secured to the circuit substrate and the plunger is pressed against a terminal electrode of the electric part in assembling process of the part in the equipment, thereby electrically connecting the part to the circuit substrate.

FIG. 8 shows a conventional spring connector of an electronic equipment, and FIG. 9 is a sectional view of the spring connector.

The spring connector 1 comprises a cylindrical tube 2 made of metal, and a metal plunger 3 slidably inserted in the tube 2 and outwardly urged by a coil spring 7. A shoulder of a flange 3*a* of the plunger 3 is pressed against a bent edge 2*a* of the tube 2 by the spring 7.

As shown in FIG. 8, the tube 2 is secured to a circuit substrate 4 by a solder 5. An electric part 6 is downwardly moved in the direction shown by an arrow at the assembling process of the electronic equipment, and a terminal electrode 6*a* of the part 6 is elastically pressed against the plunger 3 by the coil spring 7, so that the part 6 is electrically connected to the circuit substrate 4.

The underside of the flange 3*a* is inclined so that the peripheral wall of the flange is pressed against the inner surface of the tube 2 in an inclined condition. Thus the flange is strongly pressed against the inner surface, thereby ensuring the electrical conductivity between the tube and the plunger.

FIG. 10 is a sectional view showing another conventional spring connector. A plunger 3A is also hollow to form a space 3*b*. The spring 7 is inserted in the space 3*b*.

Japanese Patent Application Laid Open Publication 2002-25657 discloses another spring connector. The spring connector also has a plunger urged by a coil spring.

In the connector shown in FIG. 9, the plunger 3 occupies a considerable length of the spring connector. The length of the coil spring 7 is limited to a short length. Consequently, the stroke of the spring can not be increased.

In the spring connector of FIG. 10, although the length of the coil spring is longer than that of the coil spring of FIG. 9, the underside of the flange 3*a* of the plunger 3A is not inclined unlike the plunger of FIG. 9. Therefore, the flange 3*a* is not pressed against the inside wall of the tube 2 at a higher pressure. Therefore, contact resistance between the flange and the inside wall of the tube is low, so that the operation of the plunger becomes unstable. If the gap between the flange and the inside wall is reduced, the operation becomes stable. However, it is severe and disadvantageous for manufacturing the connector to process the connector having a small gap.

A common problem to both spring connectors of FIGS. 9 and 10 is the fact that both connectors are made of metal. Consequently, since the heat of the spring connector quickly drops, it is difficult to melt solder on the connector at reflow process of the solder. As a result, the quality of the solder process decreases.

On the other hand, since an electronic part of electronic equipment such as an IC and capacitor generally has a flat surface, the part is supplied to a mounting position by vacuum sucking. However, since each of the spring connectors of FIGS. 9 and 10 has not a flat surface, the connector can be treated by vacuum. Therefore, the connector must be treated by a special mounting device, which causes the number of steps to increase.

In the assembling step, the coil spring 7 is inserted in the tube 2, the plunger 3 is inserted in the tube, an upper portion of the tube must be staked to hold the flange 3*a*. The coil spring must be assembled one by one, which causes the manufacturing cost to increase.

SUMMARY OF THE INVENTION

An object of the present invention is to provide a spring connector which is excellent in performance and may be manufactured at a low cost.

According to the present invention, there is provided a spring connector for an electronic equipment comprising a case made of insulating material and having a space formed therein, the inner space of the case has an inclined bottom, conductive films formed on an inner surface of the case, on an upper surface of the case, on an outside wall of the case, and on an underside of the case so as to electrically connect the inside surface with the underside of the case, a coil spring provided in the space of the case, a plunger made of metal and axially slidably mounted in the space, and having space therein in which a part of the coil spring is inserted so that the plunger is outwardly urged by the coil spring, and a lid member for preventing the plunger from popping out of the case.

The plunger has a flange at a lower portion, the flange is slidably engaged with the inner surface of the case, the lid member is engaged with the flange.

Both ends of the coil spring are different from an intermediate portion in diameter.

In an aspect of the present invention, the lid member having a flat surface and having an opening from which the plunger is projected works to prevent the plunger from popping out of the case.

The present invention further provides a method for manufacturing a spring connector comprising the steps of molding a case aggregation comprising a plurality of cases in resin, each of the case having a space, molding a lid aggregation comprising a plurality of lids in resin, each lid having an opening, forming conductive films on each of the cases so as to electrically connect an inner surface of the case, an upper surface, an outside wall and an underside of the case, inserting a coil spring and a plunger in the space of the case, securing the lid aggregation to the upper surface of the case aggregation, and cutting the case aggregation and the lid aggregation to divide each case.

In another method for manufacturing a spring connector, the case aggregation and the lid aggregation are cut into individual main parts and into individual lids, and an assembling jig having a plurality of recesses for mounting the main parts is provided.

Each of the main parts mounted in the recess of the assembling jig, and each of the lids are secured to the upper surface of the case.

These and other objects and features of the present invention will become more apparent from the following detailed description with reference to the accompanying drawings.

DETAILED DESCRIPTION OF THE PREFERRED EMBODIMENT

Figure 1:
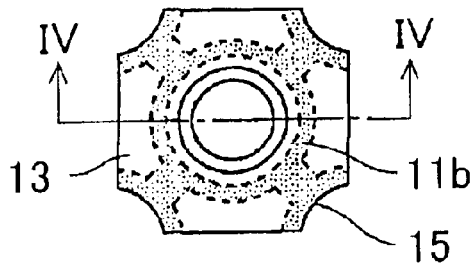
FIG. 1 is a plan view of a spring connector according to the present invention.
Figure 2:
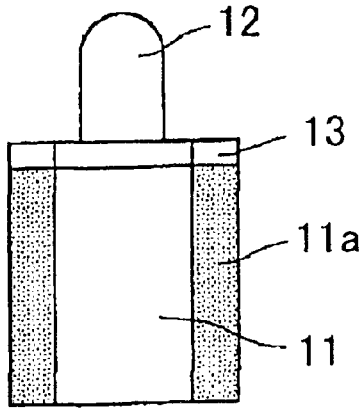
FIG. 2 is a front view of the spring connector.
Figure 3:
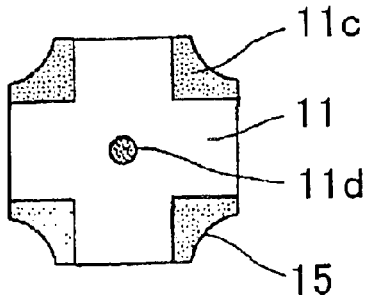
FIG. 3 is an underside view.

FIG. 1 is a plan view of a spring connector according to the present invention, FIG. 2 is a front view, and FIG. 3 is an underside view.

Figure 4A:
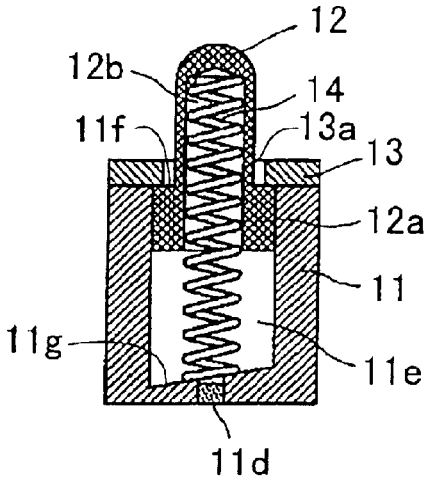
FIGS. 4*a* to 4*g* show various examples of the spring connector, each of which is a sectional view taken along a line IV—IV of FIG. 1.
Figure 4B:
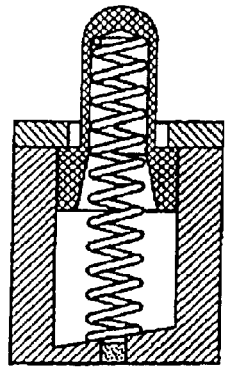
Figure 4C:
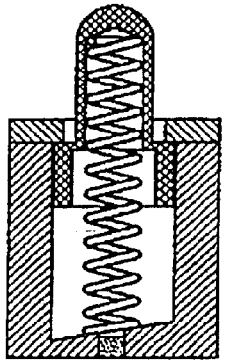
Figure 4D:
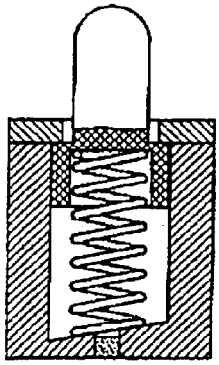

The spring connector comprises a case 11 made of insulating material such as resin, a plunger 12 made of conductive metal and slidably inserted in the case, and a lid 13 made of insulating material. The case 11 has a square pillar, arcuated recesses 15 are formed at four corners, and a space 11*e* (FIG. 4*a*). The lid 13 has the same shape as the case 11 in plan view as shown in FIG. 1 and secured on the case 11 by an adhesive. Sandy patterns in FIGS. 1–3 represent conductive films formed by plating of metal such as Cu+Ni+Au. The conductive films comprise side films 11*a* on the recesses 15, upper film 11*b* on the upper surface of the case 11, lower films 11*c* on the underside of the case, and cylindrical film formed on the side wall of the space 11*e* of the case 11. The cylindrical film is connected to the upper film 11*b*, the upper film is connected to the side films 11*a* which are connected to the lower films 11*c*. The lower films 11*c* are terminal electrodes to be contacted with a circuit substrate.

There is formed a hole 11*d* in the bottom plate of the case 11 as shown in FIG. 3 so as to increase flow efficiency of plating liquid. After plating, the hole 11*d* is closed by supersonic wave processing or charging of resin.

FIGS. 4*a* to 4*g* show various examples of the spring connector, each of which shows a sectional view taken along a line IV—IV of FIG. 1. In the example of FIG. 4*a*, the space 11*e* of the case 11 has an opening 11*f* and the lid 13 has also an opening 13*a*. The bottom 11*g* of the inner space 11*e* is inclined. This inclination of the bottom affects the coil spring 14 and the plunger 12 to incline against the inner surface of the case 11. It helps the contact resistance between the plunger 12 and the inner surface of the case 11 stable. The plunger 12 is hollow to form a space 12*b*. A flange 12*a* of the plunger 12 is slidably engaged with the inside surface of the case 11. A coil spring 14 is inserted in the spaces 11*e* and 12*b*. The body of the plunger 12 is outwardly projected from the openings 11*f* and 13*a*, and the flange 12*a* is pressed to the lid 13 by the spring 14.

Since the bottom 11*g* of the inner space 11*e* is inclined, the coil spring 14 is tilted, thereby to tilt the plunger 12. Therefore, the flange 12*a* of the plunger is pressed against the inner surface of the case 11 so that the contacting resistance between the flange and the inner surface becomes constant.

In the examples of FIGS. 4*b* to 4*e*, the shape of the space 12*b* is changed.

Figure 4E:
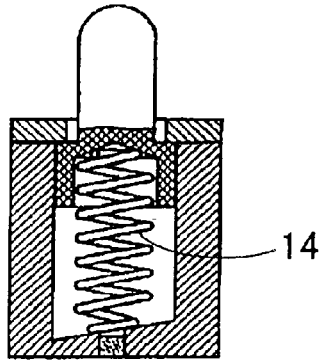

In the example of FIG. 4*e*, diameters of the coil spring 14 are reduced at both ends. It is possible to reduce the diameter at a central portion of the spring. These designs are provided so that the coil spring is easily tilted.

Figure 4F:
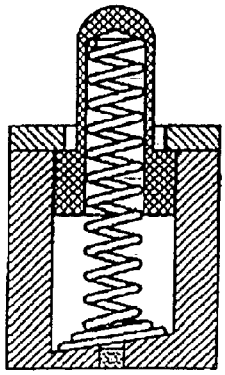
Figure 4G:
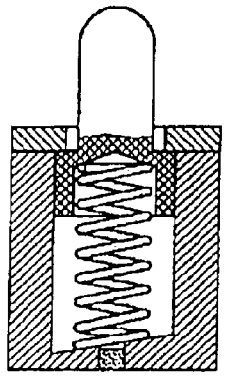

In the spring connector of FIG. 4*f*, the diameter of the coil spring is increased at a lower end portion in order to stabilize the lower end of the spring. By stabilizing the end portion of the spring, it is possible to tilt the plunger. The spring connector of FIG. 4*g* is designed by combining the connectors of FIGS. 4*d* and 4*e*.

As a method for securing the lid 13 to the upper surface of the case 11, various methods such as supersonic wave welding, heat staking, adhering and others may be used.

Figure 5:
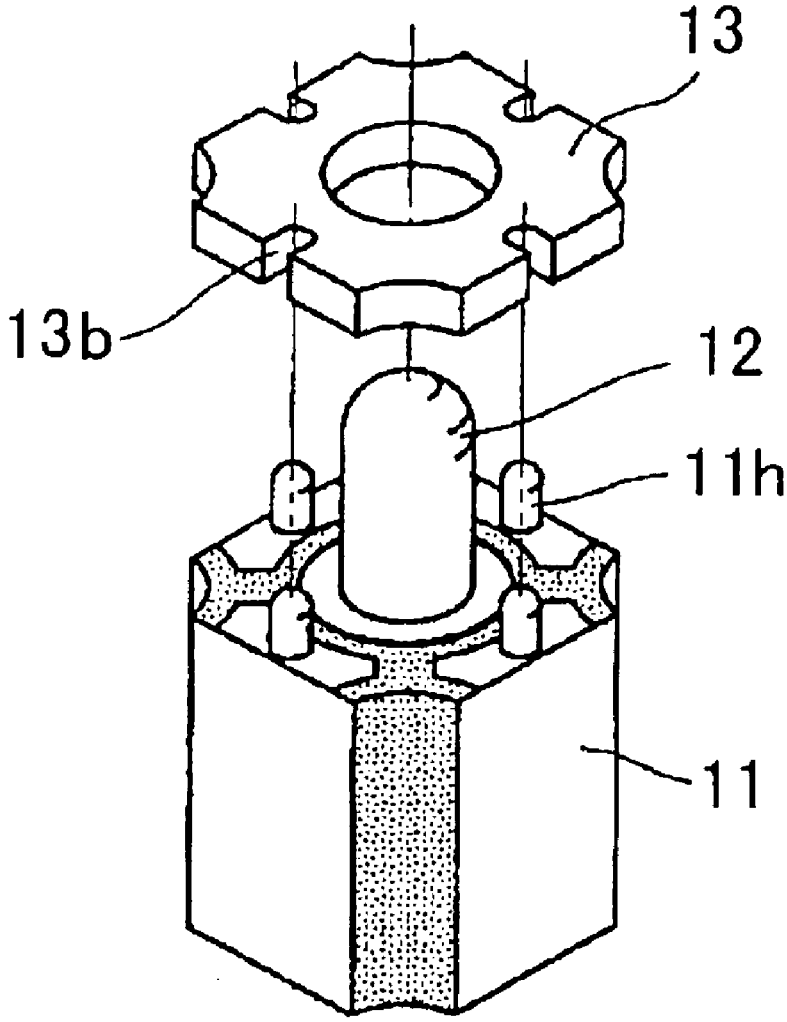
FIG. 5 is a perspective view showing an example of beat staking.

FIG. 5 is a perspective view showing an example of the heat staking.

Cylindrical projections 11*h* are formed on the upper surfaces of the case 11 around the plunger 12. On the other hand, notches 13*b* are provided in the lid 13 corresponding to the projections 11*h*. The notches 13*b* are engaged with the projections 11*h*, and the lid 13 is mounted on the upper surface of the case 11, thereby upwardly projecting each projection 11*h* from the lid. The projected portion of the projection is melted by a heating head, so that the projection 11*h* is staked to secure the lid 13 to the case 11.

Figure 6:
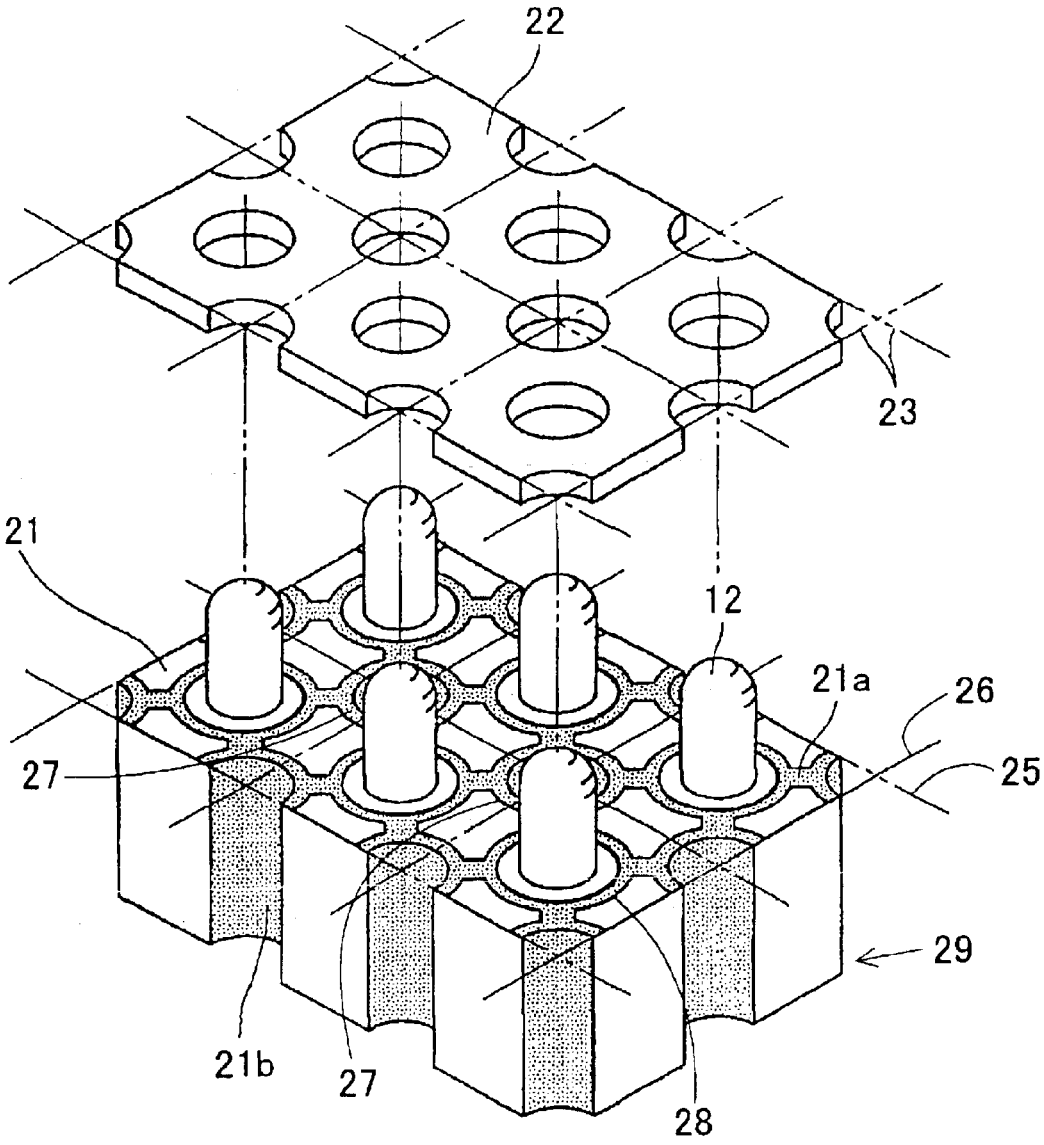
FIG. 6 is a perspective view showing an example of a method for manufacturing a plurality of spring connectors.

FIG. 6 is a perspective view showing an example of a method for manufacturing a plurality of spring connectors. A case aggregation 21 comprising a plurality of cases is manufactured by molding of insulating material. Although six cases are shown in FIG. 6, a large number of cases are manufactured in actual process. The cases are arranged in matrix, defined by cutting lines 25 and 26. At each intersection of cutting lines 25 and 26, a cylindrical hole 27 is formed. At a central portion of each case, a cylindrical hole 28 is formed. Conductive films 21*a* on the upper surface of the case aggregation 21, films on inside walls of the holes 27 and 28, conductive films 21*b* on each recess and films on the underside of the case aggregation are formed by plating of metal with covering unnecessary portions by sheets.

In each hole 28, a coil spring (not shown) and the plunger 12 are provided. Thus, a main part aggregation 29 is manufactured. Then, a lid aggregation 22 is mounted on the case aggregation 21 and secured to the case aggregation 21 by suitable method.

Finally, the lid aggregation 22 and main part aggregation 29 are diced by a cutter along cutting lines 23, 25, 26. Thus, a plurality of spring connectors are manufactured. Recesses 15 shown in FIG. 3 are formed at four corners of each spring connector by cutting the holes 27.

Figure 7:
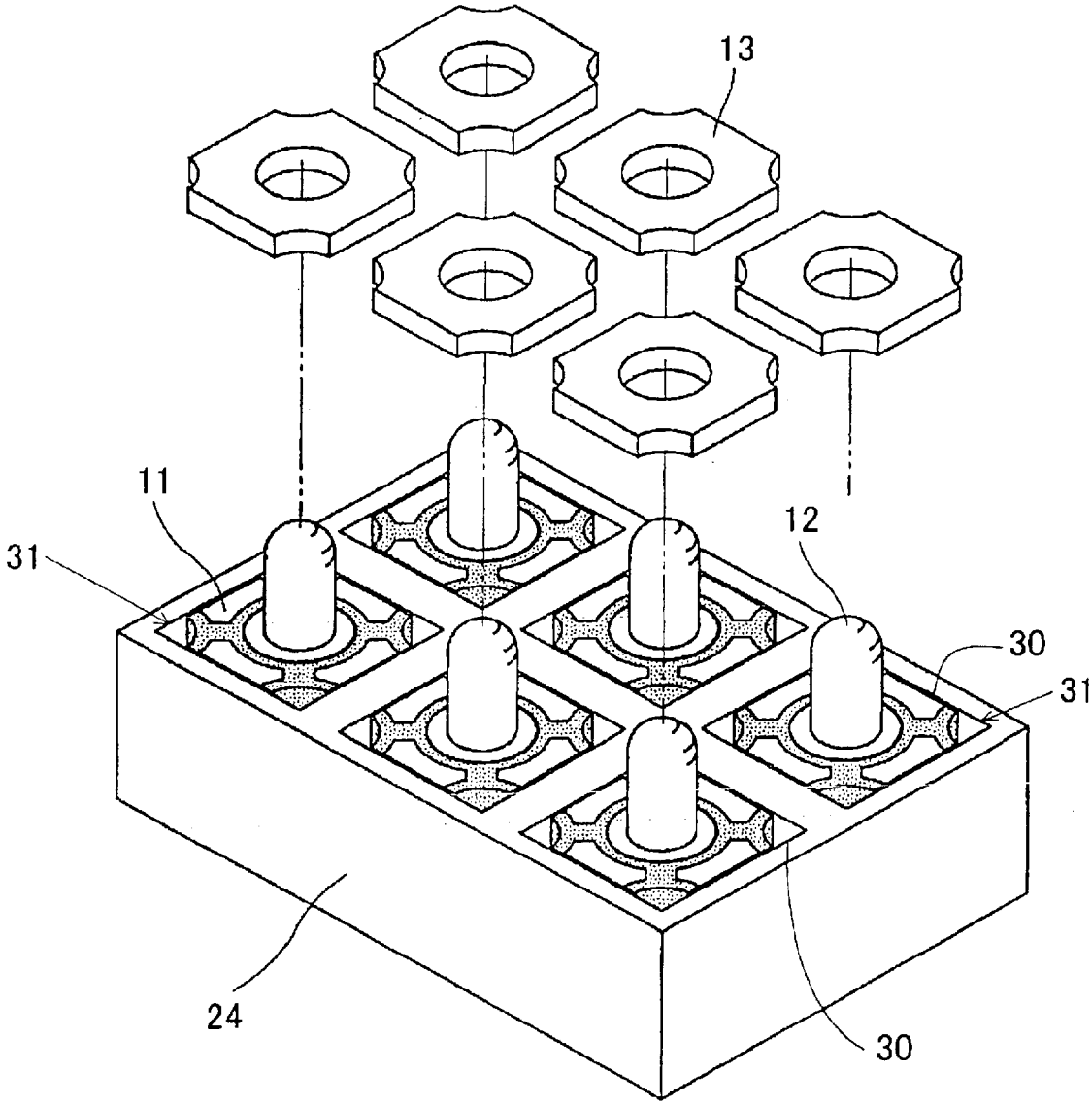
FIG. 7 is a perspective view showing another example of a manufacturing method.
Figure 8:
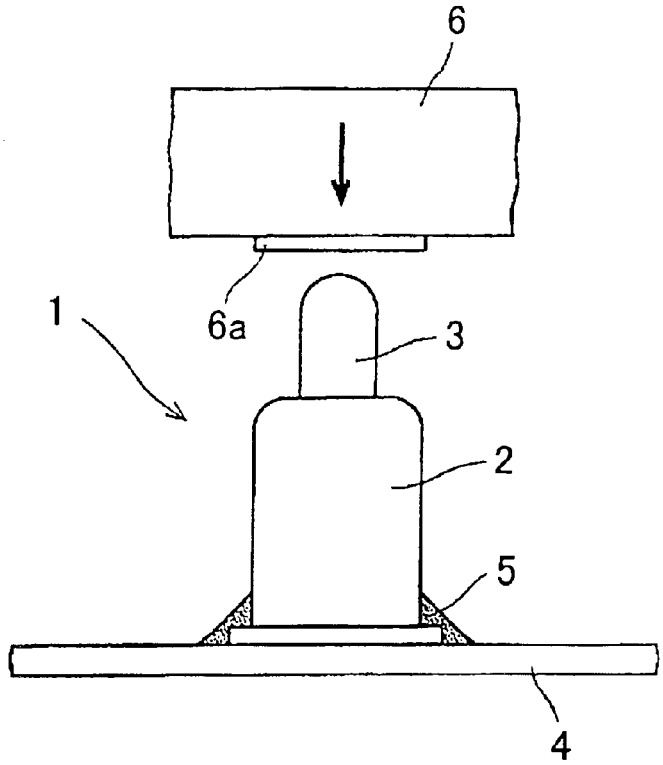
FIG. 8 PRIOR ART
FIG. 8 shows a conventional spring connector of an electronic equipment.
Figure 9:
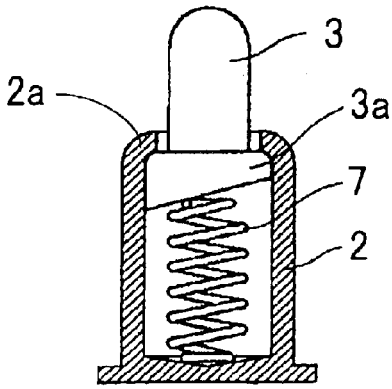
FIG. 9 PRIOR ART
FIG. 9 is a sectional view of the spring connector.
Figure 10:
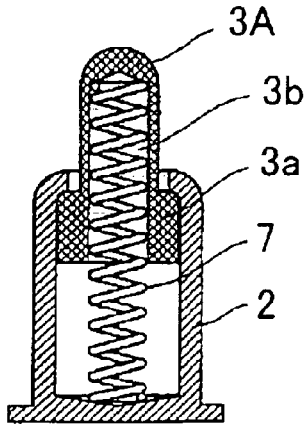
FIG. 10 PRIOR ART
FIG. 10 is a sectional view showing another conventional spring connector.

FIG. 7 is a perspective view showing another example of a manufacturing method.

In the method, an assembling jig 24 is provided. In the jig 24, a plurality of recesses 30 are formed for mounting cases 11. The main part aggregation 29 and the lid aggregation 22 manufactured by the method described with reference to FIG. 6 are cut into individual main parts 31 and into individual lids 13. Each main part 31 is inserted in the recess 30, and the lid 13 is mounted on the case 11 and secured thereto. Since the lid 13 is independently mounted on the case 11, accurate center alignment of the lid for the plunger can be obtained.

In the accordance with the present invention, since the case is made of insulating material and conductive film portion is small in area, the case is excellent in heat retention. Therefore, the solder provided on the case is easily melt, thereby improving reflow operation. By inclining the underside of a bottom of a case, the plunger is tilted by the coil spring so that the plunger is pressed against the inside wall of the case, thereby stabilizing the contacting resistance.

While the invention has been described in conjunction with preferred specific embodiment thereof, it will be understood that this description is intended to illustrate and not limit the scope of the invention, which is defined by the following claims.

What is claimed is:

1. A spring connector for an electronic equipment comprising:

a case made of insulating material and having a space formed therein;

conductive films formed on an inner surface of the case, on an outer surface of the case, so as to electrically connect the inner surface and the outer surface of the case;

a coil spring provided in the space of the case;

a plunger made of metal and axially slidably mounted in the space, and having a space therein in which a part of the coil spring is inserted so that the plunger is outwardly urged by the coil spring; and a lid member attached to the case and having an opening through which the plunger is projected.

2. The spring connector according to claim 1 wherein the inner space of the case has an inclined bottom.

3. The spring connector according to claim 1 wherein the plunger has a flange at a lower portion, the flange is slidably engaged with the inside wall of the space of the case, the lid member is engaged with the flange.

4. The spring connector according to claim 1 wherein at least one end of the coil spring is different from an intermediate portion in diameter.

5. The spring connector according to claim 1 wherein the lid member is attached to the case by applying the means such as ultrasonic adhesion, heat caulking, adhesive sheet, or adhesive paste.

* * * * *